US011602940B2

(12) United States Patent
Nozaki

(10) Patent No.: US 11,602,940 B2
(45) Date of Patent: Mar. 14, 2023

(54) PRINTER

(71) Applicant: TOSHIBA TEC KABUSHIKI KAISHA, Tokyo (JP)

(72) Inventor: Mitsuhiro Nozaki, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 173 days.

(21) Appl. No.: 17/227,589

(22) Filed: Apr. 12, 2021

(65) Prior Publication Data

US 2022/0055382 A1 Feb. 24, 2022

(30) Foreign Application Priority Data

Aug. 19, 2020 (JP) ..... JP2020-138904

(51) Int. Cl.

| | |
|---|---|
| ***B41J 11/00*** | (2006.01) |
| ***B41J 3/407*** | (2006.01) |
| ***B41J 11/46*** | (2006.01) |
| ***B41J 11/66*** | (2006.01) |

(52) U.S. Cl.

CPC ..... *B41J 11/0095* (2013.01); *B41J 3/4075* (2013.01); *B41J 11/46* (2013.01); *B41J 11/663* (2013.01)

(58) Field of Classification Search

CPC ..... B41J 11/0095; B41J 3/4075; B41J 11/46; B41J 11/663

See application file for complete search history.

(56) References Cited

U.S. PATENT DOCUMENTS

| | | | | |
|---|---|---|---|---|
| 5,613,790 A * | 3/1997 | Miazga | B41J 11/46 250/559.27 |
| 8,113,610 B2 * | 2/2012 | Nishizaka | B41J 11/0095 347/5 |
| 2009/0102878 A1 * | 4/2009 | Yamada | B41J 11/0095 347/16 |

(Continued)

FOREIGN PATENT DOCUMENTS

JP 2014-172173 9/2014

OTHER PUBLICATIONS

Extended European Search Report for European Patent Application No. 21176829.6 dated Oct. 26, 2021.

*Primary Examiner* — David H Banh

(74) *Attorney, Agent, or Firm* — Amin, Turocy & Watson, LLP

(57) ABSTRACT

A printer according to an embodiment includes a conveying unit, a holding unit, a supporting unit, a second detecting unit, and a control unit. The conveying unit conveys paper. The holding unit includes a light emitting unit configured to radiate light and a first detecting unit configured to detect the light reflected on the paper. The supporting unit supports the holding unit to be movable in an orthogonal direction orthogonal to a conveying direction of the paper. The second detecting unit is disposed on an opposite side of the light emitting unit across a paper conveying path, on which the conveying unit conveys the paper, and detects the light radiated by the light emitting unit. The control unit determines, based on a detection result of the second detecting unit, whether the light emitting unit is present in a position opposed to the second detecting unit.

20 Claims, 7 Drawing Sheets

(56) References Cited

U.S. PATENT DOCUMENTS

| | | | | |
|---|---|---|---|---|
| 2010/0208026 | A1* | 8/2010 | Yoshie | B41J 3/4075<br>347/225 |
| 2014/0347673 | A1* | 11/2014 | Nara | G01B 11/002<br>356/498 |
| 2020/0276835 | A1* | 9/2020 | Kasamatsu | B41J 11/0095 |

* cited by examiner

PRINTER

CROSS-REFERENCE TO RELATED APPLICATION

This application is based upon and claims the benefit of priority from Japanese Patent Application No. 2020-138904, filed on Aug. 19, 2020, the entire contents of which are incorporated herein by reference.

FIELD

Embodiments described herein relate generally to a printer.

BACKGROUND

There has been known a printer including a reflection type sensor that reflects light on paper to detect a mark for specifying a cutting position of the paper and a transmission type sensor in which a light receiving unit and a light emitting unit are disposed to be opposed across a paper conveying path. In such a printer, since a position of the mark is different depending on paper, the position of the reflection type sensor is optionally movable.

However, if the reflection type sensor and the light emitting unit are disposed on the same substrate, the position of the light emitting unit changes if the position of the reflection type sensor changes. The light receiving unit and the light emitting unit of the transmission type sensor are not opposed if the position of the light emitting unit is changed. Therefore, the light receiving unit cannot detect light radiated by the light emitting unit. Therefore, in some case, the light cannot be detected as originally intended and is erroneously detected. Accordingly, there is a demand for a technique capable of determining whether the light receiving unit and the light emitting unit of the transmission type sensor are present in opposed positions.

DETAILED DESCRIPTION

An aspect of embodiments is to provide, in order to solve the problem described above, a printer that can determine whether a light receiving unit and a light emitting unit are present in opposed positions.

A printer according to an embodiment includes a conveying unit, a holding unit, a supporting unit, a second detecting unit, and a control unit. The conveying unit conveys paper. The holding unit includes a light emitting unit configured to radiate light and a first detecting unit configured to detect the light reflected on the paper. The supporting unit supports the holding unit to be movable in an orthogonal direction orthogonal to a conveying direction of the paper. The second detecting unit is disposed on an opposite side of the light emitting unit across a paper conveying path, on which the conveying unit conveys the paper, and detects the light radiated by the light emitting unit. The control unit determines, based on a detection result of the second detecting unit, whether the light emitting unit is present in a position opposed to the second detecting unit.

An embodiment is explained in detail below with reference to the accompanying drawings. The embodiment explained below is an example of a printer and does not limit the configuration, the specifications, and the like of the printer.

Figure 1:
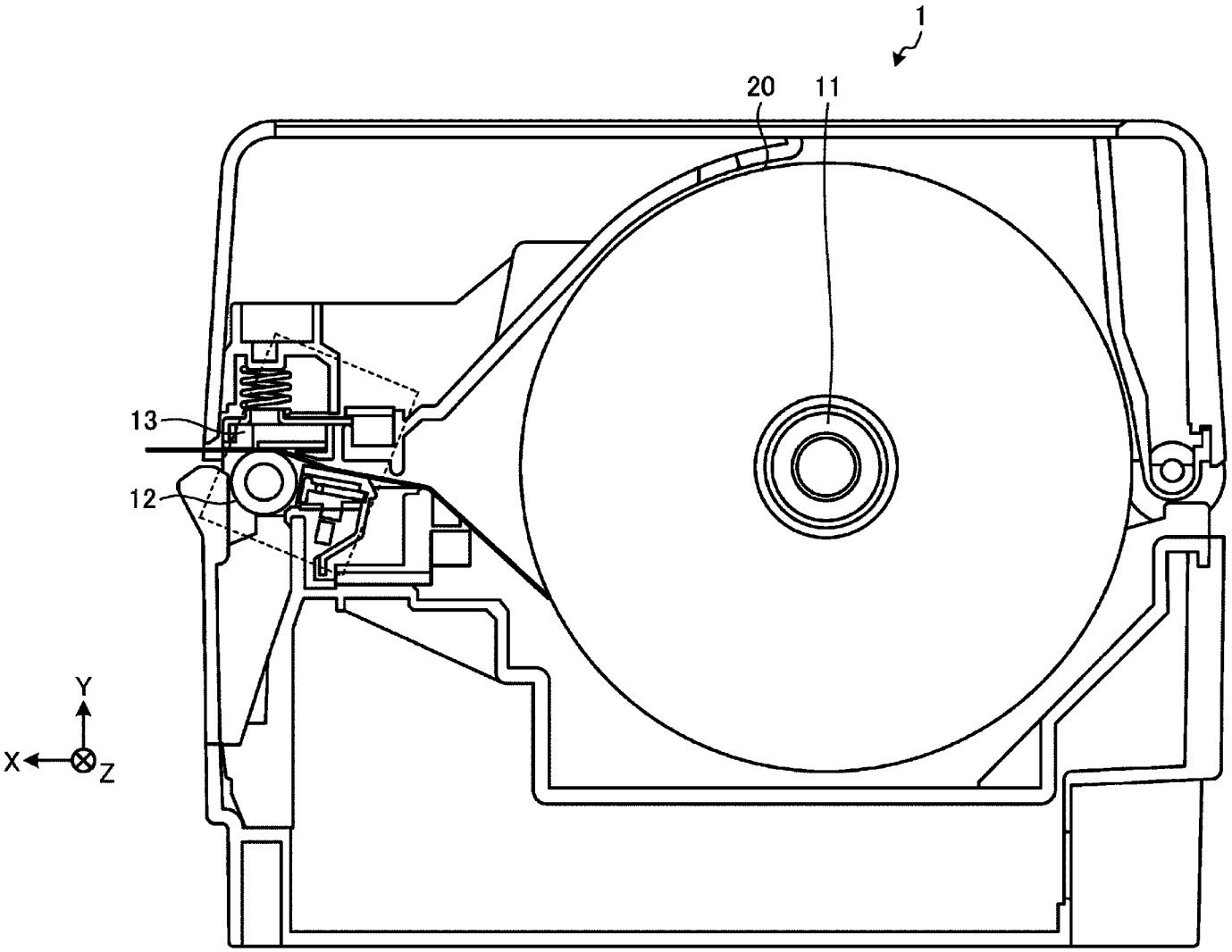
FIG. 1 is a sectional view illustrating an example of an internal configuration of a printer according to an embodiment.

FIG. 1 is a sectional view illustrating an example of an internal configuration of a printer 1 according to this embodiment. The printer 1 includes a paper holding shaft 11, a platen roller 12, and a printing head 13. In FIG. 1, a conveying direction of paper 20 is an X-axis direction. A direction orthogonal to the X-axis direction and parallel to the horizontal direction is a Z-axis direction. A direction orthogonal to the X-axis direction and parallel to the vertical direction is a Y-axis direction.

The paper holding shaft 11 is a shaft that holds the paper 20 wound in a roll shape. The platen roller 12 conveys the paper 20. The platen roller 12 is an example of the conveying unit. More specifically, the platen roller 12 is a roller that rotates to thereby convey the paper 20 held by the paper holding shaft 11. The platen roller 12 presses the paper 20 against the printing head 13. The printing head 13 prints on the paper 20 conveyed by the rotation of the platen roller 12.

Figure 2:
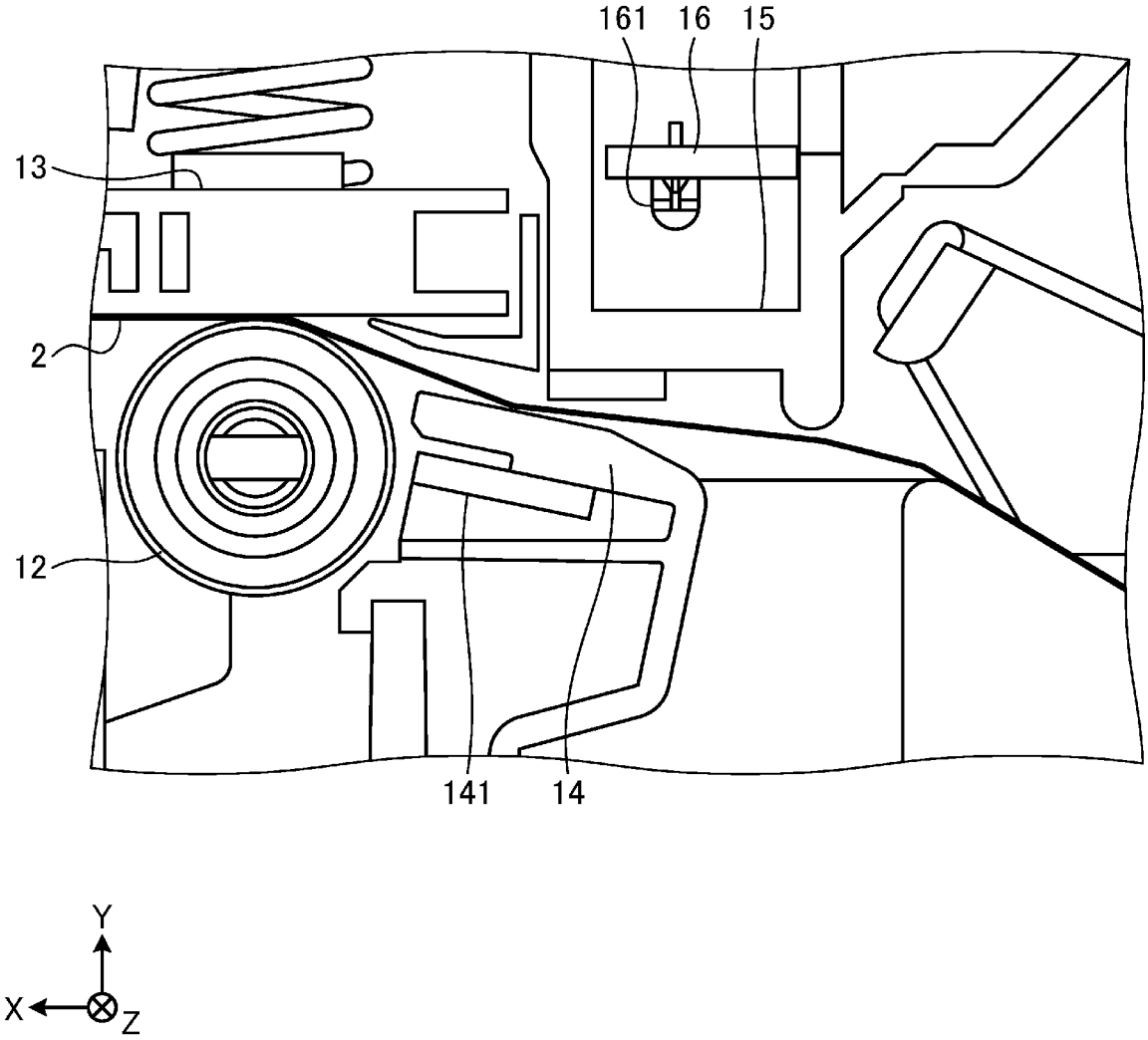
FIG. 2 is an enlarged view of a region surrounded by a broken line in FIG. 1.
Figure 3:
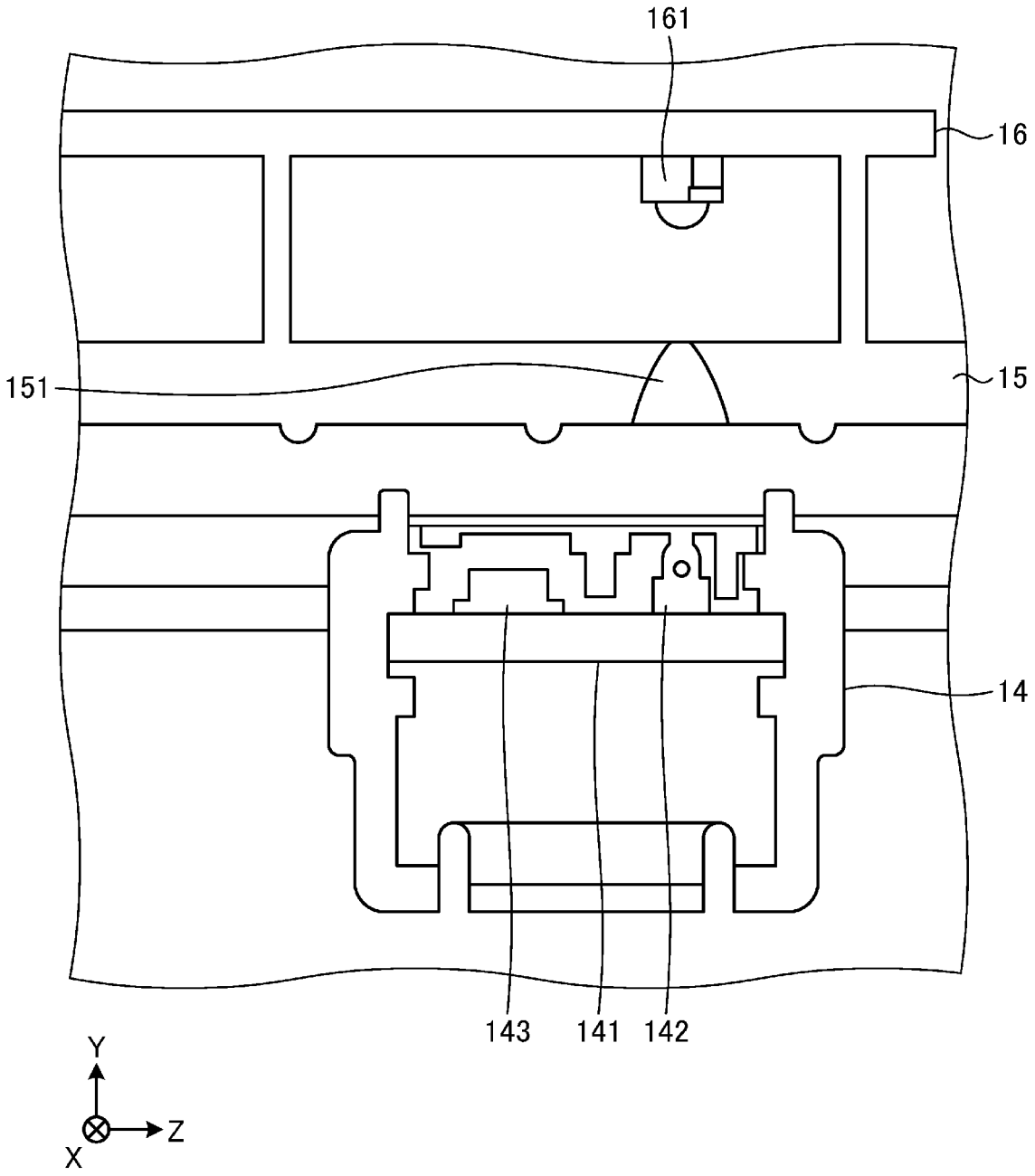
FIG. 3 is an enlarged view of the region surrounded by the broken line in FIG. 1 viewed from an X-axis direction.

In the printer 1, a sensor that detects the paper 20 is disposed in a region surrounded by a broken line in FIG. 1 between the paper holding shaft 11 and the printing head 13. FIG. 2 is an enlarged view of the region surrounded by the broken line in FIG. 1. FIG. 3 is an enlarged view of the region surrounded by the broken line in FIG. 1 viewed from the X-axis direction.

The printer 1 includes, below a paper conveying path on which the paper 20 is conveyed, a supporting unit 14 that supports a first sensor substrate 141 including a light emitting unit 142 and a reflection type sensor 143. The supporting unit 14 supports the first sensor substrate 141 to be movable in an orthogonal direction orthogonal to the conveying direction of the paper 20. For example, the supporting unit 14 causes the first sensor substrate 141 to slide on a not-illustrated rail to thereby support the first sensor substrate 141 to be movable in the orthogonal direction orthogonal to the conveying direction of the paper 20. That is, the supporting unit 14 supports the first sensor substrate 141 to be movable in the Z-axis direction.

The first sensor substrate 141 includes the light emitting unit 142 that radiates light and the reflection type sensor 143 that detects the light reflected on the paper 20. The first sensor substrate 141 is an example of the holding unit.

The light emitting unit 142 radiates light. For example, the light emitting unit 142 is a light emitting element such as an LED (Light Emitting Diode).

The reflection type sensor 143 is a sensor including a light emitting element and a light receiving element. The light receiving element receives reflected light of light radiated by the light emitting element, whereby the reflection type sensor 143 detects an object. For example, the reflection type sensor 143 detects light reflected on the paper 20 conveyed on the paper conveying path. The reflection type sensor 143 is an example of the first detecting unit.

The printer 1 includes, on the opposite side across the paper conveying path, a second sensor substrate 16 including a light receiving unit 161. The light receiving unit 161 is disposed on the opposite side of the light emitting unit 142 across the paper conveying path on which the platen roller 12 conveys the paper 20. The light receiving unit 161 detects light radiated by the light emitting unit 142. The light receiving unit 161 is an example of the second detecting unit. The light receiving unit 161 outputs a signal indicating a light amount of received light.

The second sensor substrate 16 is covered by a wall 15. That is, the light receiving unit 161 is covered by the wall 15. As illustrated in FIGS. 2 and 3, the wall 15 includes a funnel-shaped opening 151 that narrows toward the light receiving unit 161. Consequently, if the light receiving unit 161 and the light emitting unit 142 are not disposed in opposed positions, the wall 15 hinders the light receiving unit 161 from detecting light of the light emitting unit 142.

As illustrated in FIG. 3, if the light emitting unit 142 and the light receiving unit 161 are disposed on the same straight line, the light emitting unit 142 and the light receiving unit 161 form a transmission type sensor. The transmission type sensor detects the paper 20 on the paper conveying path according to whether light radiated by the light emitting unit 142 passes through the opening 151 and is received by the light receiving unit 161.

Figure 4:
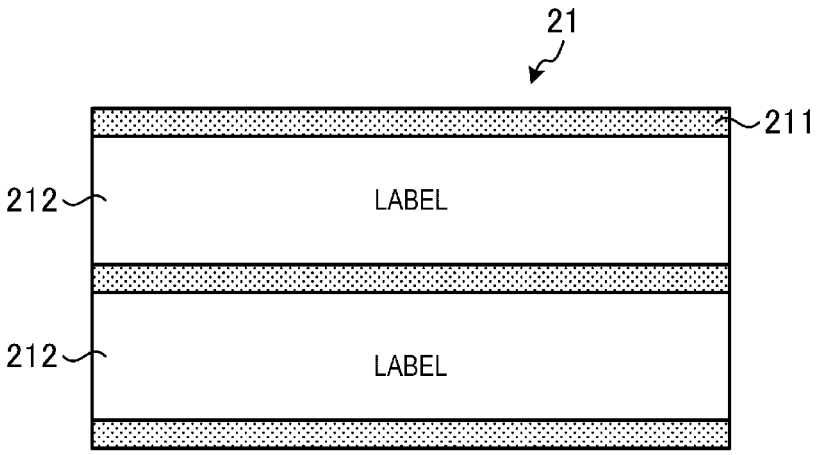
FIG. 4 is a diagram illustrating an example of label paper with mount.
Figure 5:
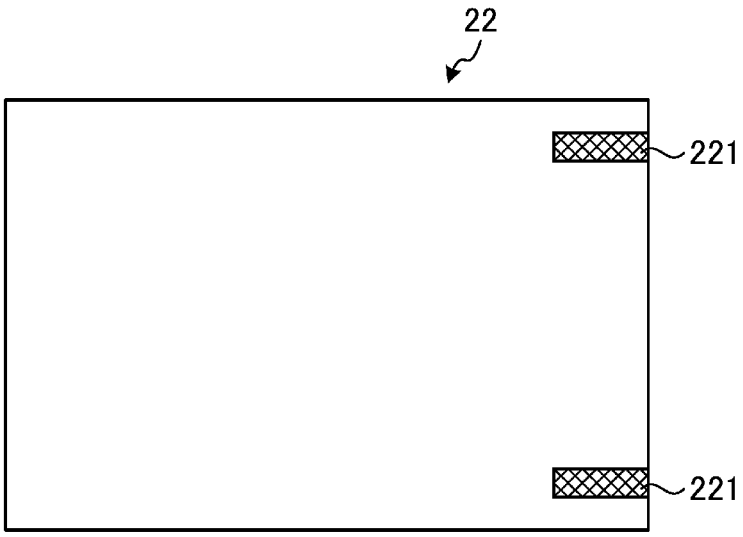
FIG. 5 is a diagram illustrating an example of paper with black marks.

The reflection type sensor 143 and the transmission type sensor detect a separation of the paper 20 according to a type of the paper 20. FIG. 4 is a diagram illustrating an example of label paper with mount 21. FIG. 5 is a diagram illustrating an example of paper with black marks 22.

In the label paper with mount 21, as illustrated in FIG. 4, labels 212 are arranged at every fixed interval on a mount 211. Places where the labels 212 are not arranged are thin because the labels 212 are absent. The light receiving unit 161 of the transmission type sensor detects the intensity of light radiated by the light emitting unit 142 to detect the places where the labels 212 are not arranged on the mount 211. The printer 1 cuts the label paper with mount 21 in the places where the labels 212 are not arranged on the mount 211. Consequently, the printer 1 prevents the labels 212 from being cut.

As illustrated in FIG. 5, the paper with black marks 22 includes marks called black marks 221. The black marks 221 are marks indicating cutting positions of belt-like paper 20 wound in a roll shape. The reflection type sensor 143 radiates light to the paper 20 and detects the light reflected by the paper 20 to detect the black marks 221. If detecting the black marks 221, the printer 1 cuts the paper 20 in positions specified by the black marks 221.

In FIG. 5, the black marks 221 are arranged on the right side of the paper 20. However, the black marks 221 are not specified and are arranged in different positions for each type of the paper 20. Therefore, the supporting unit 14 supporting the reflection type sensor 143 is capable of moving in the direction orthogonal to the conveying direction of the paper 20. Consequently, since the reflection type sensor 143 is disposed in a position corresponding to the type of the paper 20, the reflection type sensor 143 can detect the black marks 221.

However, the first sensor substrate 141 supported by the supporting unit 14 includes not only the reflection type sensor 143 but also the light emitting unit 142 of the transmission type sensor. Accordingly, if the position of the reflection type sensor 143 is moved, the position of the light emitting unit 142 is also moved. Consequently, the light emitting unit 142 and the light receiving unit 161 are not disposed in the opposed positions. As a result, the light receiving unit 161 cannot receive light radiated by the light emitting unit 142 irrespective of whether the paper 20 is present on the paper conveying path. Therefore, even if the paper 20 is absent on the paper conveying path, the printer 1 erroneously detects that the paper 20 is present on the paper conveying path.

Therefore, the printer 1 has a disposition determining function of determining whether the light emitting unit 142 is disposed in a position opposed to the light receiving unit 161.

Figure 6:
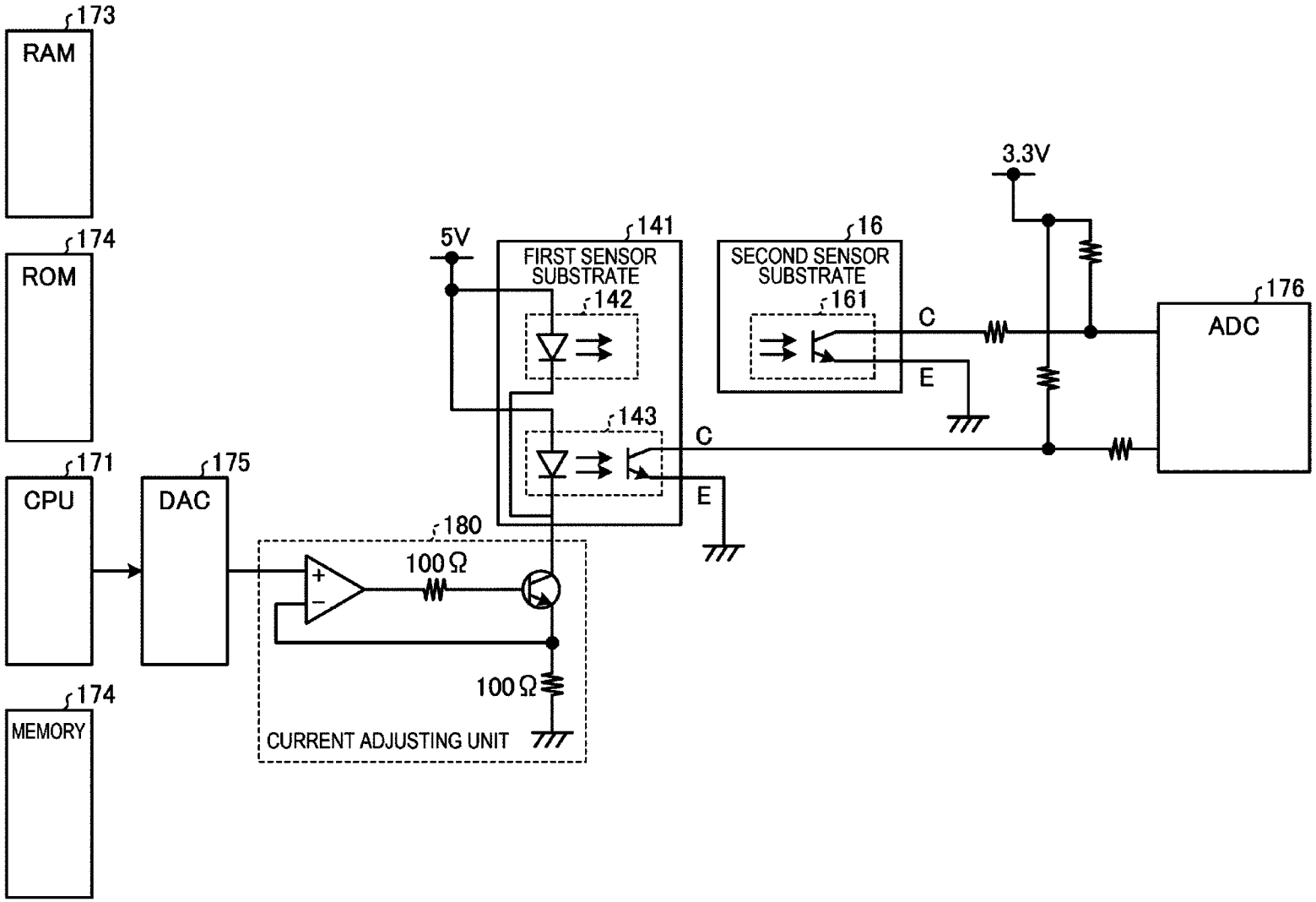
FIG. 6 is a block diagram illustrating an example of a hardware configuration of the printer.

A hardware configuration for realizing the disposition determining function of the printer 1 is explained. FIG. 6 is a block diagram illustrating an example of the hardware configuration of the printer 1.

The printer 1 includes a CPU (Central Processing Unit) 171, a ROM (Read Only Memory) 172, a RAM (Random Access Memory) 173, a memory 174, a DAC (Digital to Analog Converter) 175, an ADC (Analog to Digital Converter) 176, a current adjusting unit 180, a first sensor substrate 141, and a second sensor substrate 16.

The CPU 171 collectively controls the operation of the printer 1. The ROM 172 is a storage medium that stores various programs and data. The RAM 173 is a storage medium that temporarily stores various programs and various data. The CPU 171 executes the programs stored in the ROM 172, the memory 174, or the like using the RAM 173 as a work area. That is, the CPU 171, the ROM 172, and the RAM 173 configure a computer that controls the operation of the entire printer 1 and realizes various functions of the printer 1. The CPU 171, the ROM 172, and the RAM 173 configure an example of the control unit.

The memory 174 is a storage device such as a flash memory. For example, the memory 174 stores various settings of the printer 1.

The DAC 175 converts a digital signal output from the CPU 171 into an analog signal. The DAC 175 outputs the analog signal to the current adjusting unit 180.

The current adjusting unit 180 adjusts an electric current supplied to the light emitting unit 142. For example, the current adjusting unit 180 is a constant current circuit. The current adjusting unit 180 adjusts, based on the analog signal input from the DAC 175, the electric current supplied to the light emitting unit 142.

The ADC 176 converts an analog signal output from the light receiving unit 161 into a digital signal. The ADC 176 outputs the digital signal to the CPU 171.

Figure 7:
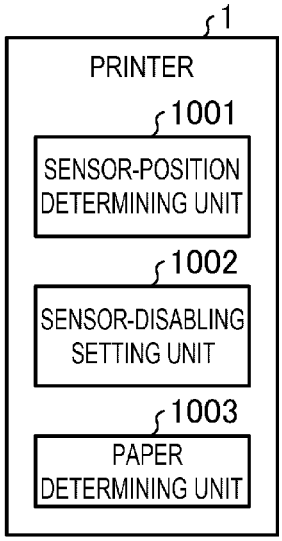
FIG. 7 is a block diagram illustrating characteristic functional components included in the printer.

Characteristic functions of the various devices of the printer 1 are explained. FIG. 7 is a block diagram illustrating characteristic functional components included in the printer 1.

The CPU 171 of the printer 1 loads, in the RAM 173, a control program stored in the ROM 172 or the memory 174 and operates according to the control program to generate functional units in the RAM 173. Specifically, the printer includes a sensor-position determining unit 1001, a sensor-disabling setting unit 1002, and a paper determining unit 1003.

The sensor-position determining unit 1001 executes disposition determination processing for determining whether the light emitting unit 142 is present in the position opposed to the light receiving unit 161. That is, if the light emission by the light emitting unit 142 is varied, on condition that the light receiving unit 161 detects the varied light emission, the sensor-position determining unit 1001 determines that the light emitting unit 142 is present in the position opposed to the light receiving unit 161.

More specifically, if execution of the disposition determination processing is instructed in a state in which the paper holding shaft 11 is not holding the paper 20, the sensor-position determining unit 1001 outputs, to the DAC 175, a current adjustment signal for adjusting the electric current supplied to the light emitting unit 142. The DAC 175 converts the current adjustment signal, which is a digital signal, into an analog signal and outputs the current adjustment signal to the current adjusting unit 180. The current adjusting unit 180 adjusts, based on the current adjustment signal converted into the analog signal, the electric current supplied to the light emitting unit 142. That is, the sensor-position determining unit 1001 controls the current adjusting unit 180 to vary the light emission by the light emitting unit 142. The sensor-position determining unit 1001 determines, based on an output signal of the light receiving unit 161 input via the ADC 176, whether the light emitting unit 142 is present in the position opposed to the light receiving unit 161.

Figure 8:
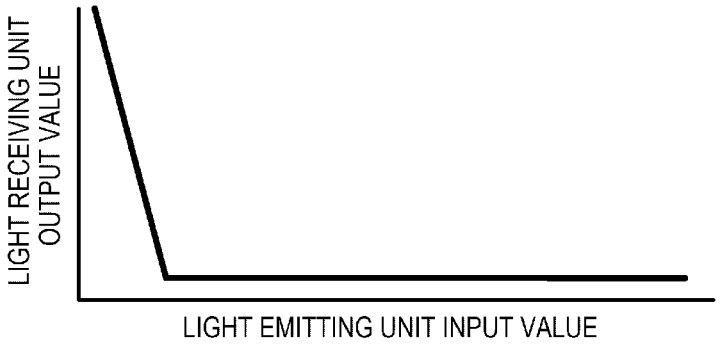
FIG. 8 is a graph illustrating an example of an input and output relation between a light emitting unit and a light receiving unit present in opposed positions.
Figure 9:
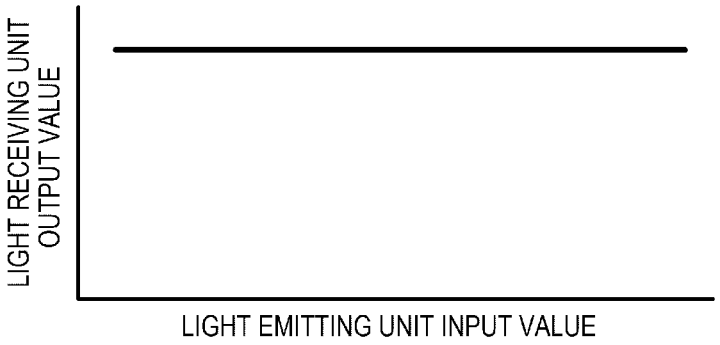
FIG. 9 is a graph illustrating an example of an input and output relation between the light emitting unit and the light receiving unit not present in the opposed positions.

FIG. 8 is a graph illustrating an example of an input and output relation between the light emitting unit 142 and the light receiving unit 161 present in the opposed positions. FIG. 9 is a graph illustrating an example of an input and output relation between the light emitting unit 142 and the light receiving unit 161 not present in the opposed positions.

A light amount of light emitted by the light emitting unit 142 changes according to a change in an electric current supplied to the light emitting unit 142. That is, if the light emitting unit 142 is present in the position opposed to the light receiving unit 161, a light amount of light received by the light receiving unit 161 increases according to an increase in a light amount of light emitted by the light emitting unit 142. Accordingly, as illustrated in FIG. 8, an output value output from the light receiving unit 161 varies according to an increase in an input value of the electric current supplied to the light emitting unit 142.

On the other hand, if the light emitting unit 142 is absent in the position opposed to the light receiving unit 161, the light amount of the light received by the light receiving unit 161 does not change because the light receiving unit 161 cannot receive light even if the light amount of the light emitted by the light emitting unit 142 increases. Accordingly, as illustrated in FIG. 9, even if the input value of the electric current supplied to the light emitting unit 142 increases, the output value output from the light receiving unit 161 does not vary. Therefore, the sensor-position determining unit 1001 determines, based on a detection result of the light receiving unit 161, whether the light emitting unit 142 is present in the position opposed to the light receiving unit 161.

The sensor-disabling setting unit 1002 does not use the detection result of the light receiving unit 161 if the light emitting unit 142 is absent in the position opposed to the light receiving unit 161. That is, the sensor-disabling setting unit 1002 stores nonuse of the transmission type sensor in the memory 174 or the like.

If the light emitting unit 142 is absent in the position opposed to the light receiving unit 161, the light receiving unit 161 does not receive the light radiated by the light emitting unit 142. Accordingly, the printer 1 cannot determine whether the light receiving unit 161 does not receive the light because the paper 20 is present on the paper conveying path or the light receiving unit 161 does not receive the light because the light emitting unit 142 is absent in the position opposed to the light receiving unit 161.

Accordingly, the printer 1 cannot specify a cutting position in the label paper with mount 21. If the printer 1 determines, based on the detection result of the light receiving unit 161, whether the paper 20 is present on the paper conveying path, the printer 1 erroneously detects that the paper 20 is present, although the paper 20 is absent. Therefore, the sensor-disabling setting unit 1002 stores nonuse of the transmission type sensor in the memory 174 or the like. Consequently, if the light emitting unit 142 is absent in the position opposed to the light receiving unit 161, it is possible to prevent the printer 1 from erroneously detecting the paper 20.

If the light emitting unit 142 is absent in the position opposed to the light receiving unit 161, the paper determining unit 1003 determines, based on a detection result of the reflection type sensor 143, whether the paper 20 is present on the paper conveying path. The reflection type sensor 143 is used for detection of the black marks 221 of the paper 20. Since the black marks 221 absorb light, a light amount of reflected light decreases. Therefore, the reflection type sensor 143 detects the black marks 221 based on a light amount of received light.

If the paper 20 is absent on the paper conveying path, the light amount of the light received by the reflection type sensor 143 decreases as in the case in which the black marks 221 are detected. Accordingly, it is sometimes difficult for the printer 1 to discriminate whether the paper 20 is absent on the paper conveying path or the black marks 221 are detected.

Therefore, the paper determining unit 1003 causes the memory 174 or the like to store the length of the black marks 221. If the light amount of the light received by the reflection type sensor 143 decreases for a time longer than the length of the black marks 221, the paper determining unit 1003 determines that the paper 20 is absent on the paper conveying path.

The paper determining unit 1003 may measure the length of the black marks 221 with any method. For example, the paper determining unit 1003 executes measurement processing for measuring the length of the black marks 221 in a state in which the paper holding shaft 11 is holding the paper 20. For example, the paper determining unit 1003 measures a time in which the light amount of the light received by the reflection type sensor 143 decreases. The paper determining unit 1003 multiplies together the measured time and conveying speed of the paper 20 to calculate the length of the black marks 221.

As explained above, in the printer 1 according to this embodiment, the supporting unit 14 supports the first sensor substrate 141 including the light emitting unit 142 of the transmission type sensor and the reflection type sensor 143 to be movable in the orthogonal direction orthogonal to the conveying direction of the paper 20. The light receiving unit 161 of the transmission type sensor is disposed on the opposite side across the paper conveying path. The printer 1 determines, based on a detection result of the light receiving unit 161 at the time when the light emitting unit 142 is caused to emit light, whether the light emitting unit 142 is present in the position opposed to the light receiving unit 161. Accordingly, the printer 1 can determine whether the light emitting unit 142 and the light receiving unit 161 are present in the opposed positions.

The several embodiments of the present invention are explained above. However, these embodiments are presented as examples and are not intended to limit the scope of the invention. These new embodiments can be implemented in other various forms. Various omissions, substitutions, and changes can be made without departing from the spirit of the invention. These embodiments and modifications of the embodiments are included in the scope and the gist of the invention and included in the inventions described in claims and the scope of equivalents of the inventions.

The programs executed by the devices in the embodiment and the modifications are incorporated in advance in storage media (ROMs or storing units) included in the devices and provided. However, not only this, but the programs may be provided while being recorded in a computer-readable recording medium such as a CD-ROM, a flexible disk (FD), a CD-R, or a DVD (Digital Versatile Disk) as a file of an installable format or an executable format. Further, the storage media are not limited to a medium independent from a computer or an incorporating system and also include a storage medium in which a program transmitted by a LAN, the Internet, or the like is downloaded and stored or temporarily stored.

The programs executed by the devices in the embodiment and the modifications may be stored on a computer connected to a network such as the Internet and provided by being downloaded through the network or may be provided or distributed through the network such as the Internet.

What is claimed is:

1. A printer, comprising:

a conveying component configured to convey paper;

a holding component including a light emitting component configured to radiate light and a first detector configured to detect the light reflected on the paper;

a supporting component configured to support the holding component to be movable in an orthogonal direction orthogonal to a conveying direction of the paper;

a second detector disposed on an opposite side of the light emitting component across a paper conveying path, on which the conveying unit conveys the paper, and configured to detect the light radiated by the light emitting component; and a controller configured to determine, based on a detection result of the second detector, whether the light emitting component is present in a position opposed to the second detector.

2. The printer according to claim 1, wherein the controller does not use the detection result of the second detector if the light emitting component is absent in the position opposed to the second detector.

3. The printer according to claim 1, wherein, if the light emitting component is absent in the position opposed to the second detector, the controller determines, based on a detection result of the first detector, whether the paper is present.

4. The printer according to claim 1, whether, if light emission by the light emitting component is varied, on condition that the second detector detects the varied light emission, the controller determines that the light emitting component is present in the position opposed to the second detector.

5. The printer according to claim 4, further comprising a current adjusting component configured to adjust an electric current supplied to the light emitting component, wherein the controller controls the current adjusting component to vary the light emission by the light emitting component.

6. The printer according to claim 1, wherein the second detector further configured to output a signal indicating a light amount of received light.

7. The printer according to claim 1, wherein the conveying component is configured to convey label paper.

8. A method for a printer, comprising:

conveying paper;

radiating light and detecting the light reflected on the paper;

a supporting component configured to moving a holding component including a light emitting component configured to radiating light and a first detector configured to detecting the light reflected on the paper in an orthogonal direction orthogonal to a conveying direction of the paper;

detecting the light radiated by the light emitting component by a second detector disposed on an opposite side of the light emitting component across a paper conveying path, on which the conveying unit conveys the paper; and determining, based on a detection result of the second detecting, whether the light emitting component is present in a position opposed to the second detector.

9. The method according to claim 8, further comprising:

not using the detection result of the second detector if the light emitting component is absent in the position opposed to the second detector.

10. The method according to claim 8, further comprising:

if the light emitting component is absent in the position opposed to the second detector, determining, based on a detection result of the first detector, whether the paper is present.

11. The method according to claim 8, further comprising:

if light emission by the light emitting component is varied, on condition that the second detector detects the varied light emission, determining that the light emitting component is present in the position opposed to the second detector.

12. The method according to claim 11, further comprising:

adjusting an electric current supplied to the light emitting component; and varying the light emission by the light emitting component.

13. The method according to claim 8, further comprising:

outputting a signal indicating a light amount of received light.

14. A printer, comprising:

a platen roller;

a printing head;

a conveying component configured to convey paper;

a holding component including a light emitting component configured to radiate light and a first detector configured to detect the light reflected on the paper;

a supporting component configured to support the holding component to be movable in an orthogonal direction orthogonal to a conveying direction of the paper;

a second detector disposed on an opposite side of the light emitting component across a paper conveying path, on which the conveying unit conveys the paper, and configured to detect the light radiated by the light emitting component; and a controller configured to determine, based on a detection result of the second detector, whether the light emitting component is present in a position opposed to the second detector.

15. The printer according to claim 14, wherein the controller does not use the detection result of the second detector if the light emitting component is absent in the position opposed to the second detector.

16. The printer according to claim 14, wherein, if the light emitting component is absent in the position opposed to the second detector, the controller determines, based on a detection result of the first detector, whether the paper is present.

17. The printer according to claim 14, whether, if light emission by the light emitting component is varied, on condition that the second detector detects the varied light emission, the controller determines that the light emitting component is present in the position opposed to the second detector.

18. The printer according to claim 17, further comprising a current adjusting component configured to adjust an electric current supplied to the light emitting component, wherein the controller controls the current adjusting component to vary the light emission by the light emitting component.

19. The printer according to claim 14, wherein the second detector further configured to output a signal indicating a light amount of received light.

20. The printer according to claim 14, wherein the conveying component is configured to convey label paper.

* * * * *